US007383832B2

(12) United States Patent
Soberg

(10) Patent No.: US 7,383,832 B2
(45) Date of Patent: Jun. 10, 2008

(54) CHANGE UP PITCHING MACHINE

(76) Inventor: John P. Soberg, 1498 Vixen La., Delano, MN (US) 55328

( * ) Notice: Subject to any disclaimer, the term of this patent is extended or adjusted under 35 U.S.C. 154(b) by 252 days.

(21) Appl. No.: 11/278,297

(22) Filed: Mar. 31, 2006

(65) Prior Publication Data

US 2006/0231082 A1 Oct. 19, 2006

Related U.S. Application Data

(60) Provisional application No. 60/667,323, filed on Apr. 1, 2005.

(51) Int. Cl.
*F41B 4/00* (2006.01)

(52) U.S. Cl. ..... 124/6

(58) Field of Classification Search ..... 124/6, 124/78

See application file for complete search history.

(56) References Cited

U.S. PATENT DOCUMENTS

| | | | | |
|---|---|---|---|---|
| 1,211,738 | A * | 1/1917 | Marty | 124/6 |
| 3,774,584 | A | 11/1973 | Paulson | |
| 4,080,950 | A | 3/1978 | Paulson et al. | |
| RE30,703 | E | 8/1981 | Paulson et al. | |
| 4,655,190 | A | 4/1987 | Harris | |
| 5,012,790 | A | 5/1991 | Bates | |
| 5,437,261 | A | 8/1995 | Paulson et al. | |
| 5,464,208 | A | 11/1995 | Pierce | |
| 5,826,568 | A | 10/1998 | Van Ross, Jr. | |
| 5,832,909 | A | 11/1998 | Grant et al. | |
| 6,026,798 | A | 2/2000 | Sanders et al. | |
| 6,093,117 | A | 7/2000 | Sherlock et al. | |
| 6,164,271 | A | 12/2000 | Paulson et al. | |
| 6,402,640 | B1 | 6/2002 | Stuart | |
| 6,415,782 | B1 | 7/2002 | Holland | |
| 6,732,724 | B1 | 5/2004 | Paulson et al. | |
| 2003/0195061 | A1 | 10/2003 | Brown | |
| 2005/0016516 | A1 | 1/2005 | Richard | |

* cited by examiner

*Primary Examiner*—John A. Ricci
(74) *Attorney, Agent, or Firm*—James R. Hakomaki; Moore & Hansen, PLLP

(57) ABSTRACT

An existing pitching machine is retrofitted to realize the capability to deliver a variety of pitches, including change-up pitches. A retrofit kit includes an add-on plate that is bolted to a casting that is attached to a stand. A ball screw actuator is connected on one end to a compression plate assembly on the existing pitching machine and on the other end to the add-on plate. A control box has a plurality of speed and potentiometers. These potentiometers are used to move the pitching machine to a preset speed and angle combination. In some embodiments, a handheld control unit has buttons associated with preset speed and angle combinations.

12 Claims, 3 Drawing Sheets

CHANGE UP PITCHING MACHINE

This application claims priority from Provisional Application Ser. No. 60/667,323 filed Apr. 1, 2005.

TECHNICAL BACKGROUND

The present invention relates generally to ball pitching machines. More particularly, the present invention relates to ball pitching machines that are capable of propelling balls with a user-controlled velocity.

BACKGROUND

In the practice of certain sports, such as baseball and softball, it is desirable to train athletes to develop batting skills. One training exercise, known as batting practice, entails delivering pitches to a batter, who attempts to hit the ball. Pitching machines are often used to deliver the pitches, as they can deliver multiple pitches without the need for rest that a human pitcher experiences. One conventional type of pitching machine incorporates a variable speed drive that allows the operator to change the speed of a pitch by adjusting a potentiometer. A manual tensioner adjusts an angle of a compression plate that is used to propel the ball. Once the speed and angle are set, the operator feeds a number of balls into the pitching machine during a batting session. While this type of pitching machine performs relatively well in terms of accuracy, one drawback is that there is no variation of pitches delivered to the batter.

In the actual play of baseball or softball, human pitchers are trained to deliver a variety of pitches in an attempt to prevent the batter from hitting the ball. Such pitches include, for example, fastballs, curveballs, sliders, knuckleballs, and change-ups. Accordingly, a pitching machine is preferably configurable to deliver a variety of pitches in order to simulate game conditions.

The change-up pitch is particularly difficult for batters to hit because it is difficult to train for. Some conventional pitching machines, particularly inexpensive pitching machines, do not provide the capability to deliver a change-up pitch. Certain other conventional pitching machines do provide the capability to deliver a change-up pitch, but require reconfiguration each time the speed or angle of the pitch is to be adjusted. For example, in some pitching machines, the operator must manually adjust the angle and speed of the pitch. The batter can see the adjustment process and anticipate the change, unlike during actual gameplay. Even if the batter cannot see the adjustment process, the adjustment process requires some time, potentially defeating the element of surprise that a human pitcher can provide.

SUMMARY OF THE DISCLOSURE

According to various example embodiments, an existing pitching machine can be retrofitted to realize the capability to deliver a variety of pitches, including change-up pitches. A retrofit kit includes an add-on plate that is bolted to a casting that is attached to a stand. A ball screw actuator is connected on one end to a compression plate assembly on the existing pitching machine and on the other end to the add-on plate. A control box has a plurality of speed and angle potentiometers. These potentiometers are used to move the pitching machine to a preset speed and angle combination. In some embodiments, a handheld control unit has buttons associated with preset speed and angle combinations.

One embodiment is directed to a pitch control module for use with a ball pitching apparatus comprising a stand, a casting attached to the stand, a compression plate attached to the casting, a motor mounted to the casting, and a wheel configured and arranged to be driven by the motor to engage a ball with the compression plate and to propel the ball. The pitch control module includes a plate attached to the casting. A ball screw actuator has one end attached to the plate and another end attached to the compression plate. The ball screw actuator can be selectively actuated to any of a plurality of positions so as to affect an angular orientation of the casting and a trajectory of the ball.

Various embodiments may provide certain advantages. For instance, the ability to deliver a variety of pitches, including change-up pitches, can be realized without the need to replace the pitching machine. Accordingly, cost savings may result. In addition, an operator can change the speed and angle of a pitch without alerting the batter, thereby preserving the element of surprise that is beneficial to developing batting skills.

Additional objects, advantages, and features of various embodiments will become apparent from the following description and the claims that follow, considered in conjunction with the accompanying drawings.

DESCRIPTION OF VARIOUS EMBODIMENTS

According to various embodiments, an existing pitching machine is retrofitted to realize the capability to deliver a variety of pitches, including change-up pitches. A retrofit kit includes an add-on plate that is bolted to a casting that is attached to a stand. A ball screw actuator is connected on one end to a compression plate assembly on the existing pitching machine and on the other end to the add-on plate. A control box has a plurality of speed and angle potentiometers. These potentiometers are used to move the pitching machine to a preset speed and angle combination. In some embodiments, a handheld control unit has buttons associated with preset speed and angle combinations.

The following description of various embodiments implemented in a vehicle-based entertainment system is to be construed by way of illustration rather than limitation. This description is not intended to limit the invention or its applications or uses. In the following description, numerous specific details are set forth in order to provide a thorough understanding of various embodiments. It will be apparent to one skilled in the art that some embodiments may be practiced without some or all of these specific details. In other instances, well known components and process steps have not been described in detail.

Figure 1:
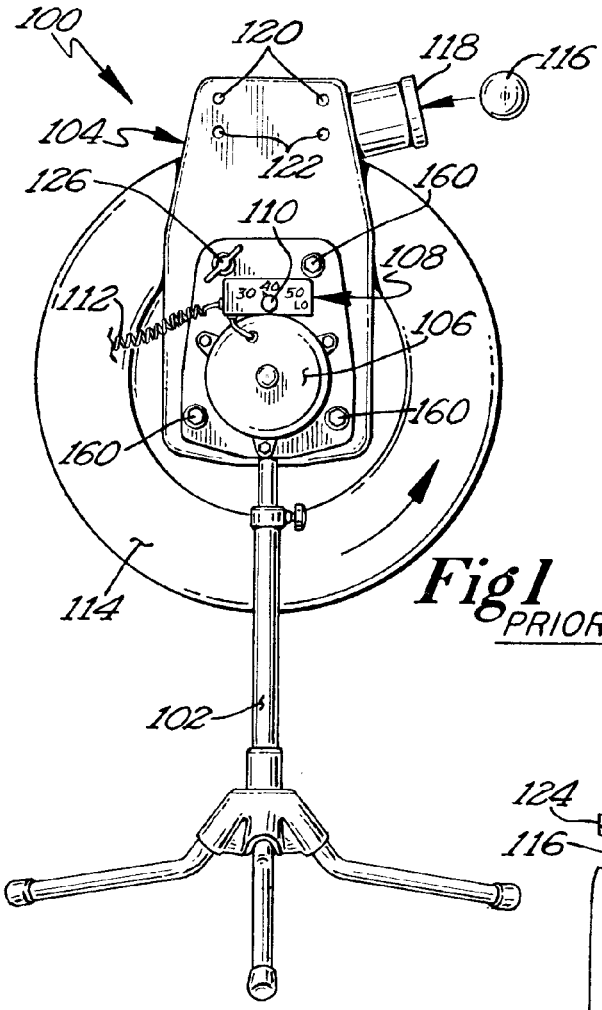
Fig 1 PRIOR ART
FIG. 1 is a side view of a conventional pitching machine.
Figure 2:
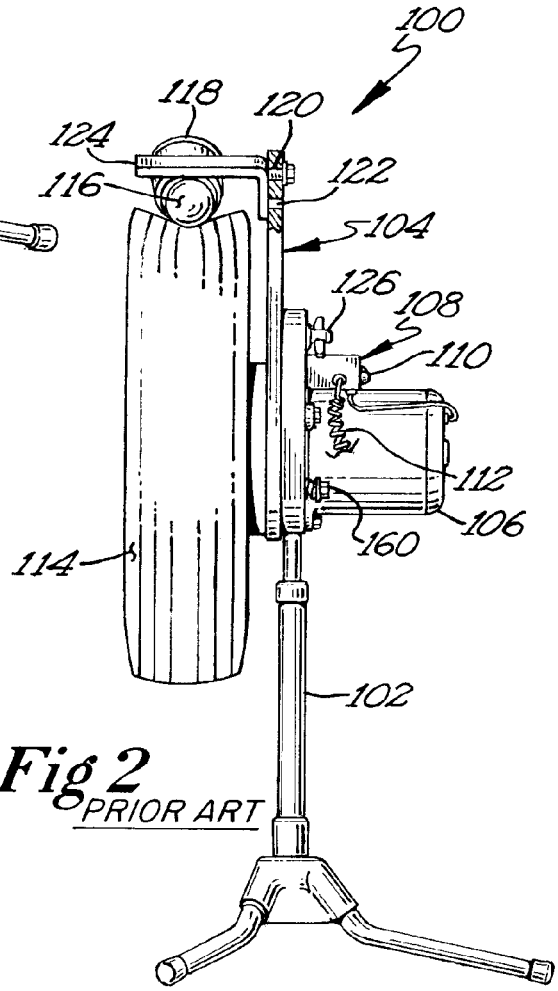
Fig 2 PRIOR ART
FIG. 2 is a front view of the pitching machine of FIG. 1.

Referring now to the drawings, FIGS. 1 and 2 are side and front views, respectively, of a pitching machine 100. The pitching machine 100 includes a stand 102 to which a casting 104 is attached. A motor 106 is mounted on the casting 104. The motor 106 may be implemented, for example, as a DC motor controlled by a DC drive control module 108. The DC drive control module 108 may incorporate a speed control potentiometer 110 and is powered by an AC power source at an AC power input 112. A shaft (not shown) of the motor 106 drives a wheel 114 at a speed determined at least in part by a setting of the speed control potentiometer 110.

In operation, a ball 116, such as a baseball or a softball, is fed by an operator into a ball chute 118 that is mounted on the casting 104 at a pair of mounting holes located on the casting 104. In the embodiment shown in FIGS. 1 and 2, the casting 104 has two pairs of mounting holes: a first pair of mounting holes 120 to configure the pitching machine 100 to pitch a softball, and a second pair of mounting holes 122 to configure the pitching machine 100 to pitch a baseball. As the wheel 114 rotates, motion is imparted to the ball 116. The ball 116 is engaged between the wheel 114 and a compression plate 124 and exits the pitching machine 100 with a speed determined by the rotational speed of the wheel 114. The operator can adjust the trajectory of the ball 116 by releasing a hand tensioner 126, rotating the casting 104 about the axis of rotation of the motor 106 to an appropriate position, and tightening the hand tensioner 126.

Figure 3:
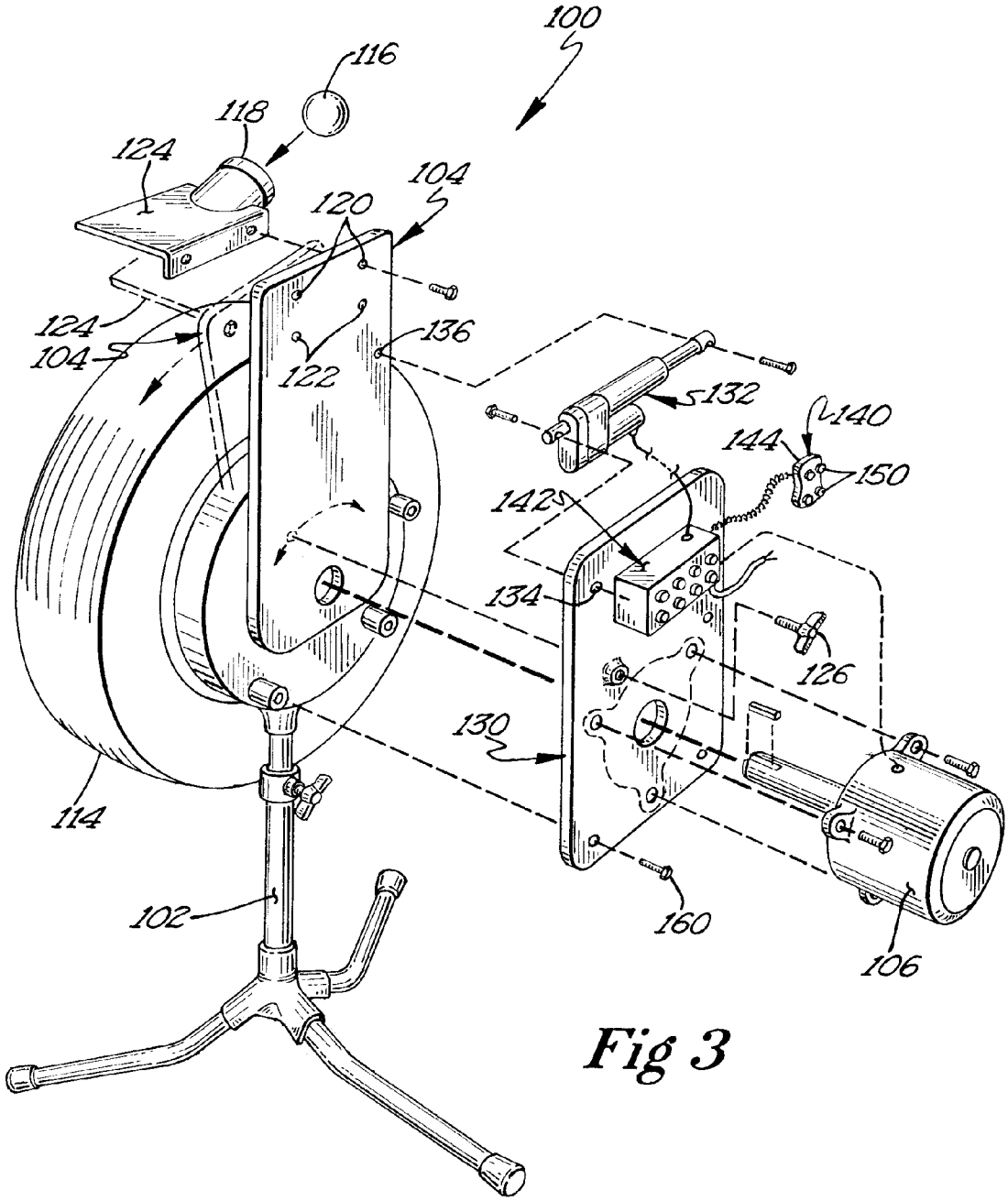
FIG. 3 is a side view of an example pitching machine configured according to one embodiment.
Figure 4:
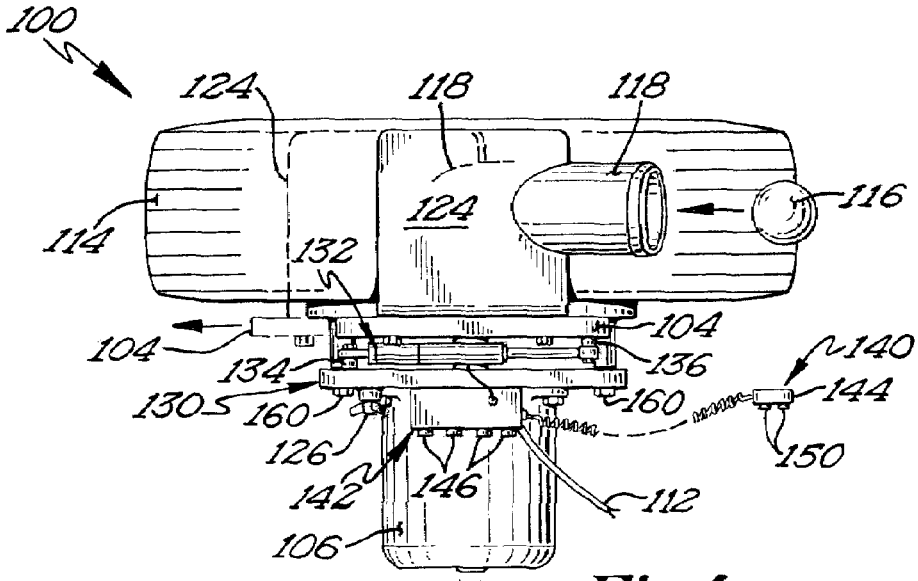
FIG. 4 is a top view of the pitching machine of FIG. 3.

FIGS. 3 and 4 are side and top views, respectively, of the pitching machine 100 equipped with a retrofit kit and configurable to deliver a variety of pitches, including change-up pitches, according to one embodiment. The retrofit kit includes a plate 130 that is bolted or otherwise attached to the casting 104. A ball screw actuator 132 is attached at one end 134 to the plate 130. Another end 136 of the ball screw actuator 132 is attached to the compression plate 124. The ball screw actuator 132 is driven by a small servo motor (not shown). A control arrangement 140 is electrically coupled to the DC drive control module 108.

Figure 5:
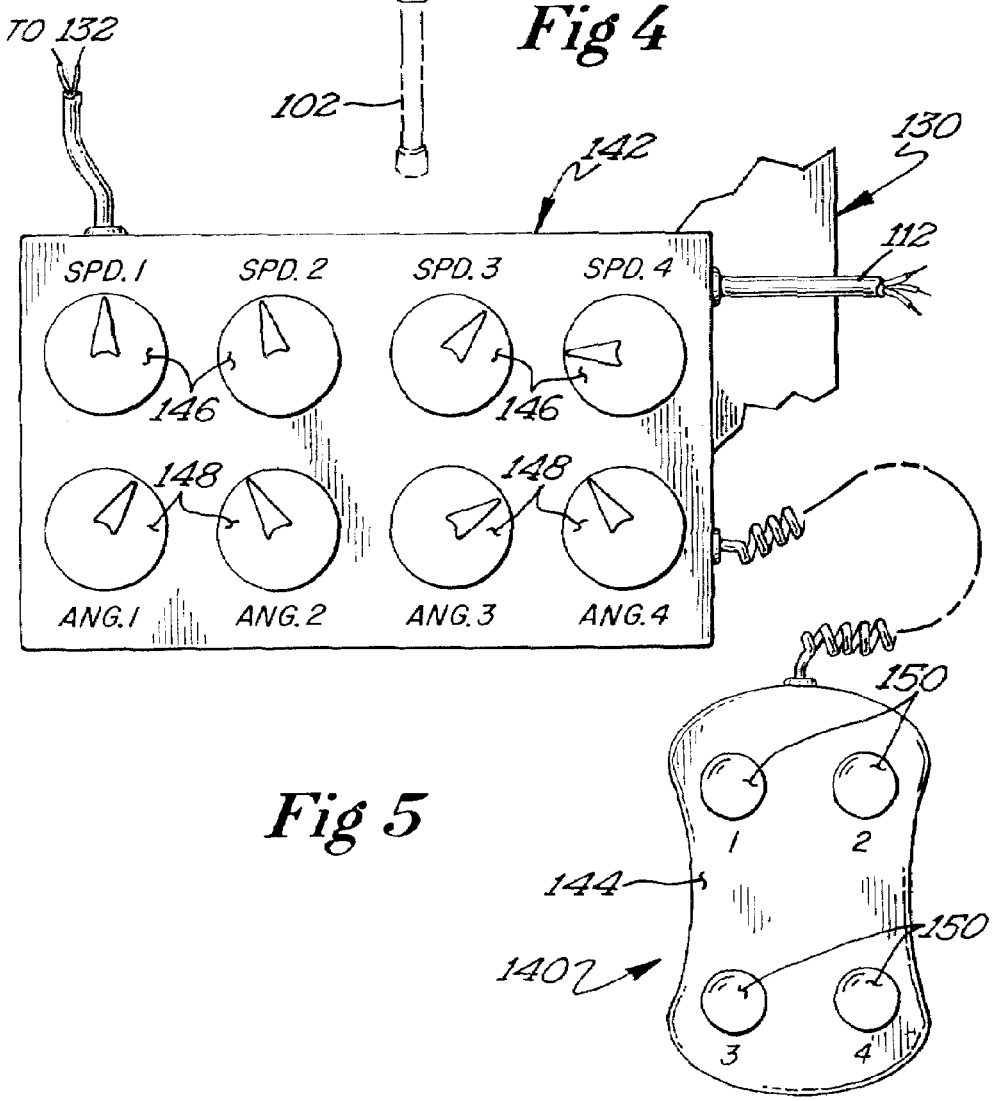
FIG. 5 is a block diagram illustrating an example control arrangement for use in controlling the pitching machine of FIG. 3 according to another embodiment.

FIG. 5 is a block diagram illustrating an example embodiment of the control arrangement 140. The control arrangement 140 includes a control panel 142 that is mounted on or near the plate 130 of FIGS. 3 and 4 and a handheld remote control unit 144 that is in communication with the control panel 142. The handheld remote control unit 144 may communicate with the control panel 142 using, for example, either a wired or a wireless connection, including but not limited to a wireless connection established and maintained according to the Bluetooth communication protocol or the IEEE 802.11b communication protocol, also known as "WiFi." This connection can also be used, for example, to upload a batting profile or roster to the control arrangement 140 or to download reports of pitches delivered.

The control panel 142 incorporates a set of speed control potentiometers 146 and a set of angle control potentiometers 148. Each speed control potentiometer 146 can be set to an appropriate resistance value to cause the pitching machine 100 to propel the ball 116 with a different speed. Similarly, each angle control potentiometer 148 can be set to an appropriate resistance to cause the pitching machine 100 to propel the ball 116 at a different trajectory. In particular, the resistance values of the angle control potentiometers 148 affect the extent of actuation of the ball screw actuator 132, which in turn determines the angular orientation of the casting 104 and the trajectory of the ball 116. In this way, the angle of a pitch can be adjusted between pitches by a few degrees.

After the speed control potentiometers 146 and the angle control potentiometers 148 have been set to appropriate resistance values, the handheld remote control unit 144 can be used to select a speed and angle combination. The handheld remote control unit 144 incorporates a number of buttons 150 or other controls, each of which is associated with a speed control potentiometer 146 and an angle control potentiometer 148. For example, pressing the button 150 labeled "1" might select the speed control potentiometer 146 labeled "SPEED 1" and the angle control potentiometer 148 labeled "ANGLE 1." If the operator presses the button 150 labeled "1," the ball screw actuator 132 would actuate to the position associated with the resistance value to which the angle control potentiometer 148 labeled "ANGLE 1" is set, and the pitching machine 100 would propel the ball 116 with the speed associated with the resistance value to which the speed control potentiometer 146 labeled "SPEED 1" is set. In the particular embodiment depicted in FIG. 5, the handheld remote control unit 144 has four buttons 150, allowing the operator to select from among four speed and angle combinations. In some embodiments, the handheld remote control unit 144 may allow the operator to program a sequence of pitches, i.e., a sequence of speed and angle combinations, by pressing a sequence of buttons 150.

The control arrangement 140 can be implemented using any of a variety of technologies. For example, the particular embodiment depicted in FIG. 5 is implemented using discrete logic. Other embodiments may employ alternative technologies, such as programmable integrated circuits, application-specific integrated circuits (ASICs), or microprocessors. Such technologies may allow the pitching machine 100 to deliver an even greater variety of pitches, rather than a variety limited by the number of speed control potentiometers 146 and angle control potentiometers 148. In addition, a microprocessor controller may allow the pitching machine 100 to adjust to the batting profile of a particular batter.

The retrofit kit is installed on an existing pitching machine by a series of relatively simple steps. First, the power to the pitching machine is disconnected. After the power is disconnected, tensioner set screws (illustrated at reference numeral 160 of FIG. 1) and the hand tensioner 126 are removed. Next, the compression plate 124 is removed. After these components are removed, the plate 130 is mounted on the holes in which the tensioner set screws 160 were previously located. The control arrangement 140 is electrically connected to the DC drive control module 108, after which the compression plate 124 is reinstalled. Finally, the preset speed and angle combinations are calibrated using the speed control potentiometers 146 and the angle control potentiometers 148.

In operation, the operator presses a button 150 on the handheld remote control unit 144 to select a speed and angle combination. As described above, the speed of the pitch is controlled by the resistance value of the speed control potentiometer 146 associated with the selected button 150. The angle of the pitch is controlled by the resistance value of the angle control potentiometer 148 associated with the selected button 150. In particular, the resistance value of the angle control potentiometer 148 controls the extent to which the ball screw actuator 132 is actuated.

The ball screw actuator 132 can be controlled to actuate to any of a number of positions, for example, using a feedback loop and an encoder (not shown) to detect the position of the ball screw actuator 132 and to actuate the ball screw actuator 132 accordingly. In some embodiments, the ball screw actuator 132 can be actuated either backward or forward to the appropriate position. In other embodiments, however, actuation of the ball screw actuator 132 is controlled so that the final movement to attain the appropriate position is always a forward movement. For example, in such embodiments, if the ball screw actuator 132 is directed to actuate backward, the ball screw actuator 132 will actuate backward past the appropriate position, then actuate forward to the appropriate position. In this way, the final movement to attain the appropriate position is a forward movement, even when the appropriate position is backward relative to the previous position. This technique may allow for greater precision control over the positioning of the ball screw actuator 132, and thus over the trajectory of the ball 116.

After the ball screw actuator 132 has actuated to the appropriate position, the ball 116 is fed into the ball chute 118 and is propelled from the pitching machine 100 with the selected speed and trajectory. In some embodiments, the control arrangement 140 imposes a delay, e.g., twelve seconds, before the next pitch can be delivered. The purpose of this delay is twofold. First, the delay makes it more difficult for the batter to detect a change in the pitch because the timing between pitches is similar regardless of whether the type of pitch has been changed. Second, the delay simulates actual game conditions, in which there is a delay between pitches delivered by a human pitcher. In some embodiments, a pair of light emitting diodes (LEDs) may be used to indicate the readiness of the pitching machine 100 to deliver a pitch. For example, a red LED may indicate that the operator must wait to deliver a pitch, while a green LED may indicate that the pitching machine 100 is ready to deliver a pitch.

Some embodiments may incorporate elements not shown in the Figures. For example, in some embodiments, a curtain or other obscuring structure may be used to conceal the operation of the pitching machine 100 from the batter, making it more difficult to anticipate the type of pitch that is to be delivered. In this way, actual game conditions may be more closely simulated. In certain embodiments, a delivery tube may be provided that holds enough balls for a hitting session. An associated control and sensing arrangement interfaces with the pitching machine to deliver the balls on demand with a particular speed and profile.

As demonstrated by the foregoing discussion, various embodiments may provide certain advantages. For example, modifying an existing pitching machine can provide the ability to deliver a variety of pitches, including change-up pitches, without the need to replace the pitching machine. Accordingly, cost savings may result. In addition, an operator can change the speed and of a pitch without alerting the batter, thereby preserving the element of surprise that is beneficial to developing batting skills.

It will be understood by those who practice the invention and those skilled in the art that various modifications and improvements may be made to the invention without departing from the spirit and scope of the disclosed embodiments. For example, other embodiments may involve retrofitting pitching machines of other types, such as those employing two wheels and those employing belts to propel the ball.

What is claimed is:

1. For use with a ball pitching apparatus comprising a stand, a casting attached to the stand, a compression plate attached to the casting, a motor mounted to the casting, and a wheel configured and arranged to be driven by the motor to engage a ball with the compression plate and to propel the ball, a pitch control module comprising:

a plate (130) attached to the casting; and a ball screw actuator (132) having a first end portion (134) attached to the plate (130) and a second end portion (136) attached to the compression plate, the ball screw actuator (132) configured to be selectively actuated to any of a plurality of positions so as to affect an angular orientation of the casting and a trajectory of the ball.

2. The pitch control module of claim 1, further comprising a control arrangement (140) in communication with the ball screw actuator (132) and configured to control an extent of actuation of the ball screw actuator (132).

3. The pitch control module of claim 2, wherein the control arrangement (140) comprises a control panel (142), the control panel (142) comprising:

a speed control potentiometer (146) configured to cause the ball pitching apparatus to propel the ball with a speed determined by a resistance value of the speed control potentiometer (146); and an angle control potentiometer (148) configured to control the extent of actuation of the ball screw actuator (132) and thereby to control the trajectory of the ball.

4. The pitch control module of claim 3, wherein the control arrangement (140) further comprises a remote control unit (144) in communication with the control panel (142).

5. The pitch control module of claim 4, wherein the remote control unit (144) is in communication with the control panel (142) via a wired communication link.

6. The pitch control module of claim 4, wherein the remote control unit (144) is in communication with the control panel (142) via a wireless communication link.

7. The pitch control module of claim 4, wherein the remote control unit (144) is configured to allow a user to program a sequence of pitches to be delivered using the ball pitching apparatus.

8. The pitch control module of claim 4, wherein the control panel (142) comprises a plurality of speed control potentiometers (146) and a plurality of angle control potentiometers (148), and wherein the remote control unit (144) is configured to allow the user to select one of the speed control potentiometers (146) and one of the angle control potentiometers (148), and thereby select any of a variety of pitches.

9. The pitch control module of claim 2, wherein the control arrangement (140) is in communication with a computer arrangement to receive a batting profile.

10. The pitch control module of claim 2, wherein the control arrangement (140) is in communication with a computer arrangement to output a summary of pitches delivered.

11. The pitch control module of claim 2, wherein the control arrangement (140) is configured to impose a minimum delay period between subsequent pitching actions by the ball pitching apparatus.

12. The pitch control module of claim 2, wherein the control arrangement (140) comprises a microprocessor.

* * * * *